US009368904B2

(12) United States Patent
Natter et al.

(10) Patent No.: US 9,368,904 B2
(45) Date of Patent: Jun. 14, 2016

(54) ELECTRICAL CONNECTOR ASSEMBLY

(71) Applicant: Lear Corporation, Southfield, MI (US)

(72) Inventors: Brantley Natter, Brighton, MI (US); Slobodan Pavlovic, Novi, MI (US); Michael Glick, Farmington Hills, MI (US); Tulasi Sadras-Ravindra, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 14/431,146

(22) PCT Filed: Oct. 21, 2013

(86) PCT No.: PCT/US2013/065901
§ 371 (c)(1),
(2) Date: Mar. 25, 2015

(87) PCT Pub. No.: WO2014/063143
PCT Pub. Date: Apr. 24, 2014

(65) Prior Publication Data

US 2015/0255912 A1 Sep. 10, 2015

Related U.S. Application Data

(60) Provisional application No. 61/716,006, filed on Oct. 19, 2012.

(51) Int. Cl.
*H01R 13/40* (2006.01)
*H01R 13/52* (2006.01)
(Continued)

(52) U.S. Cl.
CPC ..... *H01R 13/521* (2013.01); *H01R 13/18* (2013.01); *H01R 13/424* (2013.01); *H01R 13/5221* (2013.01); *H01R 13/64* (2013.01); *H01R 2101/00* (2013.01)

(58) Field of Classification Search
CPC ..... H01R 13/5221; H01R 13/5219; H01R 13/6272; H01R 13/631; H01R 13/5208; H01R 13/4365; H01R 13/4223; H01R 2101/00; H01R 13/64; H01R 13/521
USPC ..... 439/589
See application file for complete search history.

(56) References Cited

U.S. PATENT DOCUMENTS 4,932,877 A 6/1990 Zinn
6,053,754 A * 4/2000 Kano ..... H01R 13/5221 439/281

(Continued)

FOREIGN PATENT DOCUMENTS

JP 2002216862 A 8/2002
KR 20-0258721 Y1 12/2001

OTHER PUBLICATIONS

PCT International Search Report, Application No. PCT/US2013/065901, dated Feb. 12, 2014.

(Continued)

*Primary Examiner* — Jean F Duverne
(74) *Attorney, Agent, or Firm* — MacMillan, Sobanski & Todd, LLC

(57) ABSTRACT

A plug assembly for connection with a socket assembly having an electrical pin. The plug assembly includes a housing defining a cavity. The housing includes an aperture formed therein for receiving the pin. An electrical terminal is housed in the cavity of the housing. The terminal is adapted to engage with the pin. A seal is supported in the housing and is adapted to sealingly engage with the pin for sealing the cavity from an outside environment.

9 Claims, 7 Drawing Sheets

(51) Int. Cl.

| | |
|---|---|
| ***H01R 13/18*** | (2006.01) |
| ***H01R 13/424*** | (2006.01) |
| ***H01R 13/64*** | (2006.01) |
| *H01R 101/00* | (2006.01) |

(56) References Cited

U.S. PATENT DOCUMENTS

| | | | | |
|---|---|---|---|---|
| 6,364,692 | B1 * | 4/2002 | Okayasu | H01R 13/5219 439/204 |
| 6,520,788 | B2 * | 2/2003 | Ichida | H01R 13/5219 439/271 |
| 7,448,894 | B2 * | 11/2008 | Tsuji | H01R 13/4364 439/271 |
| 7,611,369 | B2 * | 11/2009 | Matsunaga | H01R 13/5219 439/271 |
| 7,658,644 | B2 * | 2/2010 | Ahn | H01R 13/5208 439/587 |
| 2003/0190830 | A1 | 10/2003 | Tanaka et al. | |
| 2004/0157505 | A1 | 8/2004 | Kuwayama et al. | |
| 2010/0311280 | A1 | 12/2010 | Tin et al. | |

OTHER PUBLICATIONS

PCT Written Opinion, Application No. PCT/US2013/065901, dated Feb. 12, 2014.

* cited by examiner

ELECTRICAL CONNECTOR ASSEMBLY

CROSS-REFERENCE TO RELATED APPLICATIONS

This application claims the benefit of U.S. Provisional Application No. 61/716,006, filed Oct. 19, 2012, the disclosure of which is incorporated herein by reference.

BACKGROUND OF THE INVENTION

Electrical connectors are used to connect various electrical components of electric vehicles, hybrid vehicles or internal combustion engine vehicles. For electric connections between components having a relatively high current draw, heavy duty connectors are often used. Heavy duty connectors are generally more robust and have larger and/or thicker electrical contacts than connectors that are used for lower current draws. One known heavy duty connection uses a threaded steel stud which electrically connects to a first electrical component. An electrical wire or cable is connected to a second electrical component. The end of the wire includes an eyelet connector. The eyelet connector is essentially a ring shaped plate having a hole formed therethrough that receives the threaded bolt. A nut is then placed over the eyelet and is threaded over the stud to trap the eyelet between the nut and a flange of the threaded stud. Although this type of connection may provide an adequate electrical connection, it has been found that over torquing or tightening the nut can strip the threads leading to a weakened or undesirable electrical connection. Under torquing the nut may also be a problem causing the loose connection to heat up causing an undesirable electrical connection. In high current applications such as electric vehicle charging, these conditions can result in undesirable thermal events due to overheating. These issues may lead to excessive warranty concerns. Eyelet connectors often use plastic covers to cover this type of electrical connection. However, the covers often do not provide sufficient protection from the environment.

SUMMARY OF THE INVENTION

This invention relates to plug assemblies and, in particular, a plug assembly for connection with a socket assembly having an electrical pin. The plug assembly comprises a housing defining a cavity. The housing includes an aperture formed therein for receiving the pin. An electrical terminal is housed in the cavity of the housing. The terminal is adapted to engage with the pin. The plug assembly may include an elastomeric seal which sealingly engages with the pin and seals the cavity from an outside environment.

In another aspect of the invention, a connector assembly comprises a socket assembly having a socket housing and an electrical pin, and a plug assembly. The plug assembly includes a plug housing defining a cavity. The housing includes an aperture formed therein for receiving the pin. An electrical terminal is housed in the cavity of the housing. The terminal is adapted to engage with the pin. The connector assembly includes a one way installation feature preventing the plug assembly from being inserted into the socket assembly in an incorrect orientation.

Various aspects of this invention will become apparent to those skilled in the art from the following detailed description of the preferred embodiments, when read in light of the accompanying drawings.

DETAILED DESCRIPTION OF THE PREFERRED EMBODIMENT

Figure 1:
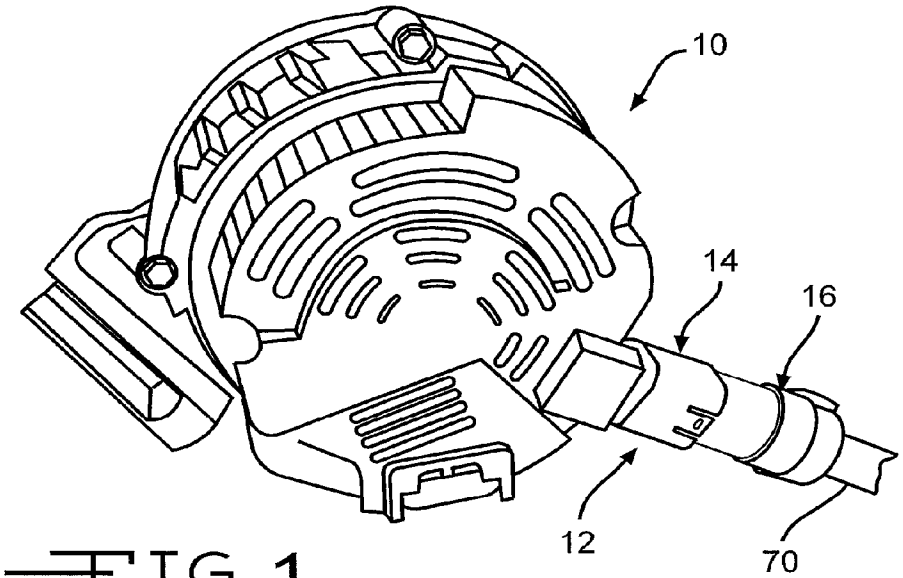
FIG. 1 is a perspective view of a motor generator including a connector assembly in accordance with the present invention.

Referring now to the drawings, there is illustrated in FIG. 1 an AC motor generator, indicated generally at 10, which incorporates a connector assembly, indicated generally at 12. The motor generator 10 is used only as an example of an electrical component which may be used with the connector assembly 12. The connector assembly 12 can be used with other suitable electrical components such as electric vehicle battery alternators, starters, batteries, and other motors. The connector assembly 12 is suited for use as a heavy duty connector in which a relatively high AC or DC current draw flows through the connector assembly 12. Such high current electrical components are used in electric and electric hybrid vehicles. Of course, the connector assembly 12 may be used in other configurations other than high current heavy duty applications.

Figure 3:
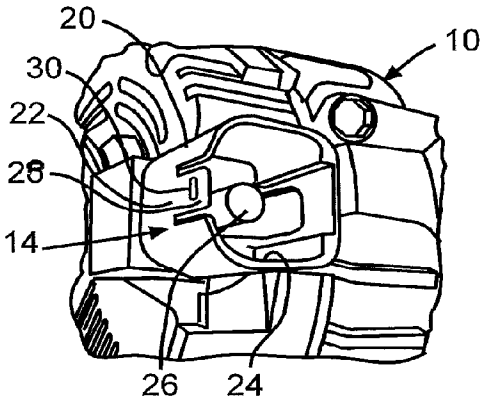
FIG. 3 is a perspective view of a socket assembly of the connector assembly mounted on the motor generator of FIG. 1.
Figure 2:
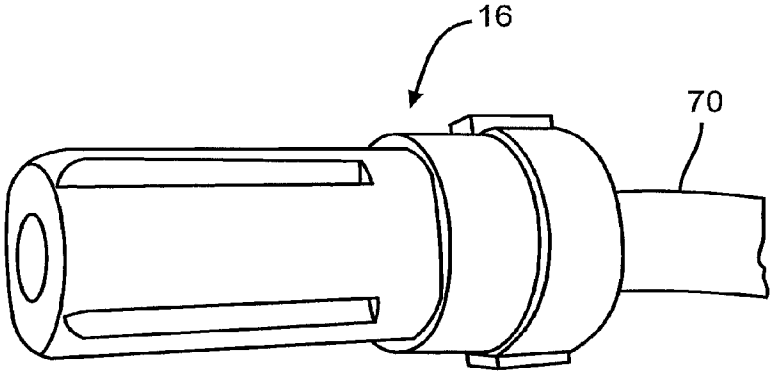
FIG. 2 is a perspective view of a plug assembly of the connector assembly of FIG. 1.
Figure 4:
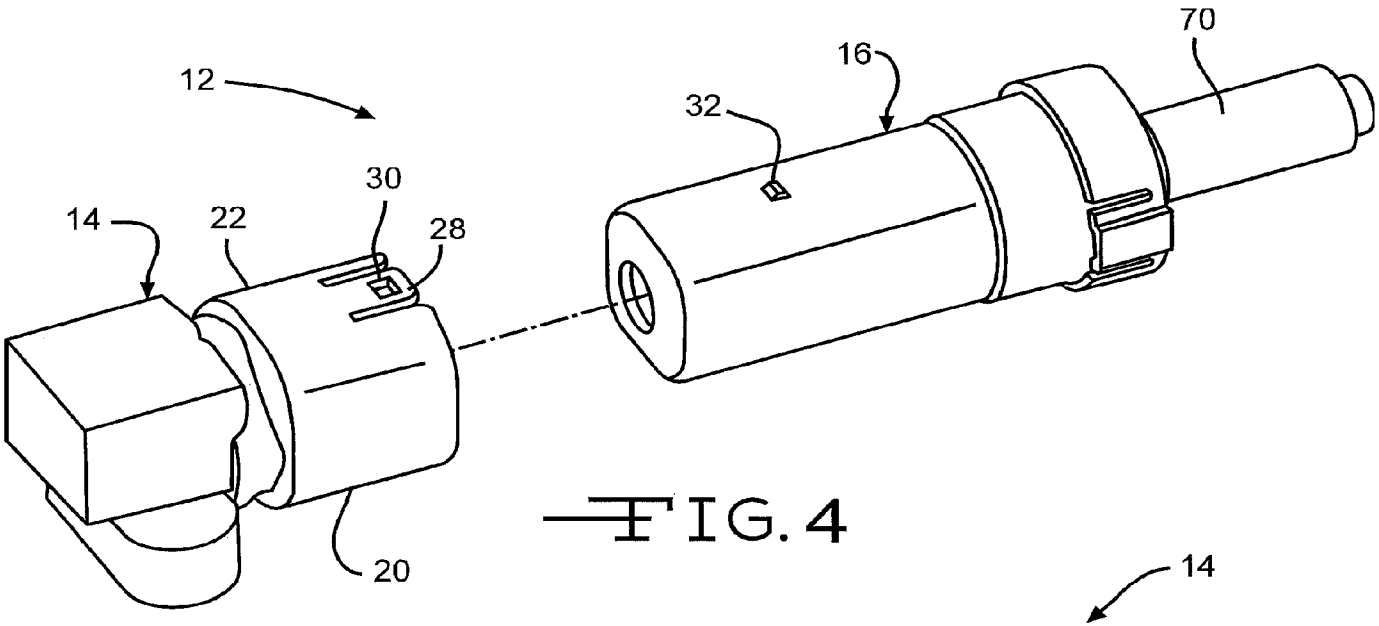
FIG. 4 is an exploded perspective view of the connector assembly of FIG. 1.
Figure 5:
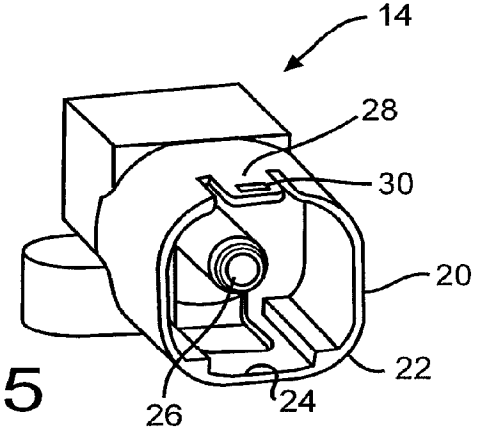
FIG. 5 is a front perspective view of the socket assembly of the connector assembly of FIG. 4.

The connector assembly 12 includes a socket assembly, indicated generally at 14, and a plug assembly, indicated generally at 16. The plug assembly 16 is inserted into the socket assembly 14 to complete an electrical connection therebetween. As shown in FIGS. 1 and 2, the socket assembly 14 includes a housing 20 having a tubular portion 22 defining a cavity 24. The tubular portion 22 may be round or rectangular shaped as shown in FIGS. 4 and 5. Disposed within the cavity 24 is an electrical conductor in the form of a cylindrical pin 26. Of course, the pin 26 need not be cylindrical and may have any suitable shape or cross-sectional shape, such as rectangular or any other polygonal shape. One or more of the walls of the housing 20 may include a resilient arm 28 having an aperture 30 formed therein. To secure the plug assembly 16 to the socket assembly 14, the aperture 30 of the resilient arm 28 mates with a hook 32 formed on a portion of the plug assembly 16 as shown in FIG. 4. Once connected, the plug assembly 16 can be removed from the socket assembly 14 by overcoming the biasing force of the resilient arm 28 to release the hook 32 from the aperture 30.

Referring to FIGS. 6 through 9, the plug assembly 16 includes an outer housing 40, an inner housing 42, and a terminal wire housing assembly, indicated generally at 44. The outer housing 40 may be made of a non-conductive material, such as plastic. The outer housing 40 is hollow defining a cavity 50 having an opening 52 on one end of the outer housing 40. At the other end of the outer housing 40 is an aperture 54 formed in an end wall 56. When the plug assembly 16 is inserted into the socket assembly 14, the pin 26 of the socket assembly 14 extends through the aperture 54 and the inner housing 42 is inserted into the cavity 50 of the outer housing 40. The inner housing 42 may also be made of a non-conductive material, such as plastic. The inner housing 42 may be secured to the outer housing 40 by hooks 41 or other fastening structures which engage with cooperating recesses 43 or other members formed in the outer housing 40.

Figure 8:
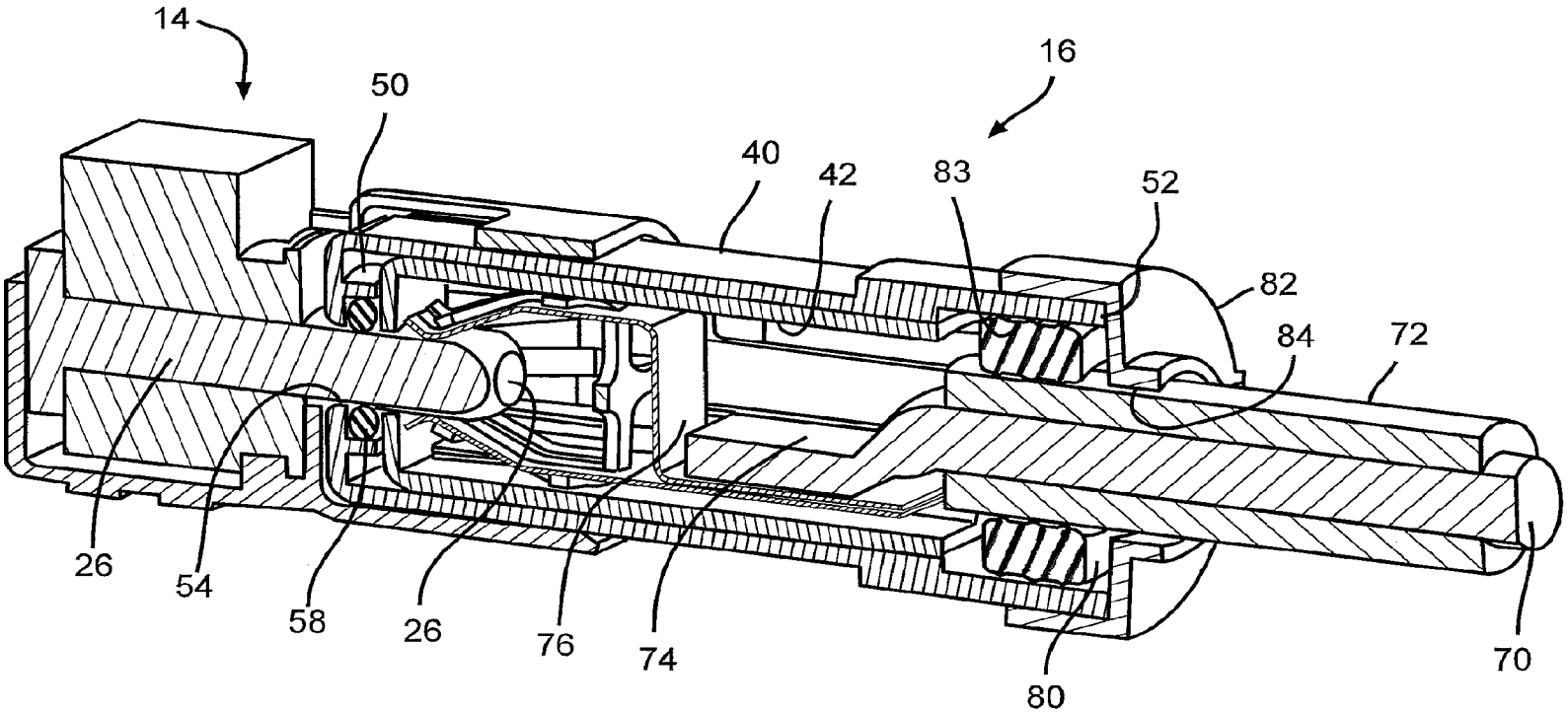
FIG. 8 is a cross-sectional view of the connector assembly.
Figure 9:
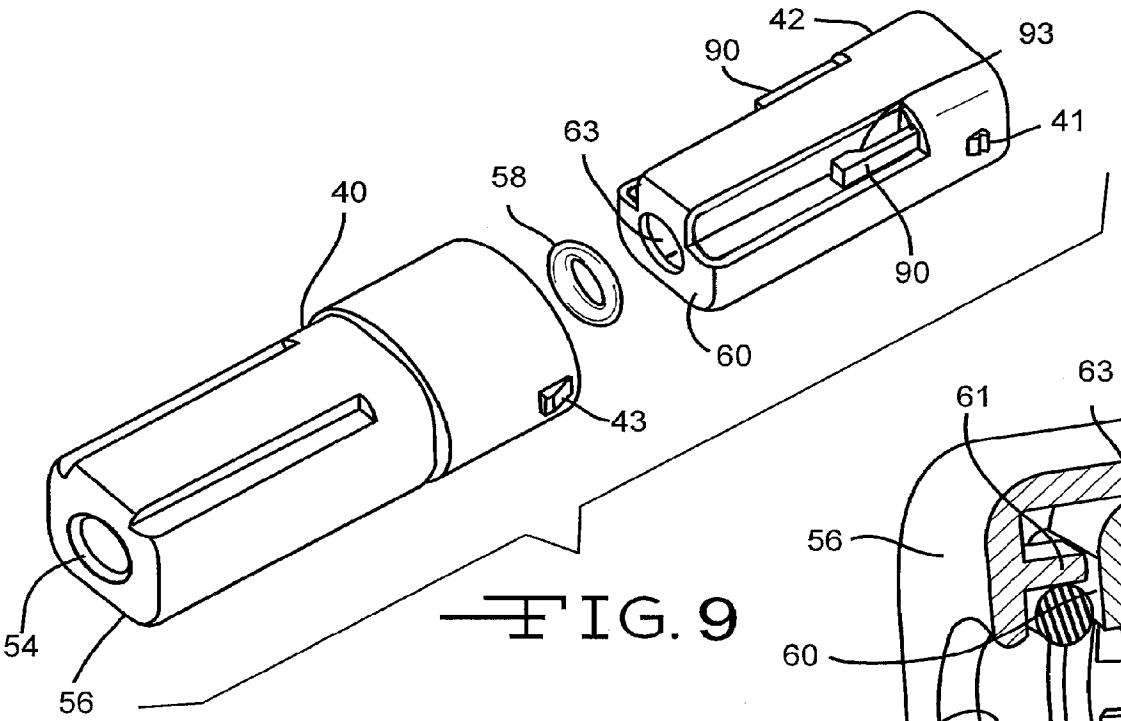
FIG. 9 is an exploded perspective view of the outer housing, pin seal, and inner housing of the plug assembly of FIG. 2.
Figure 10:
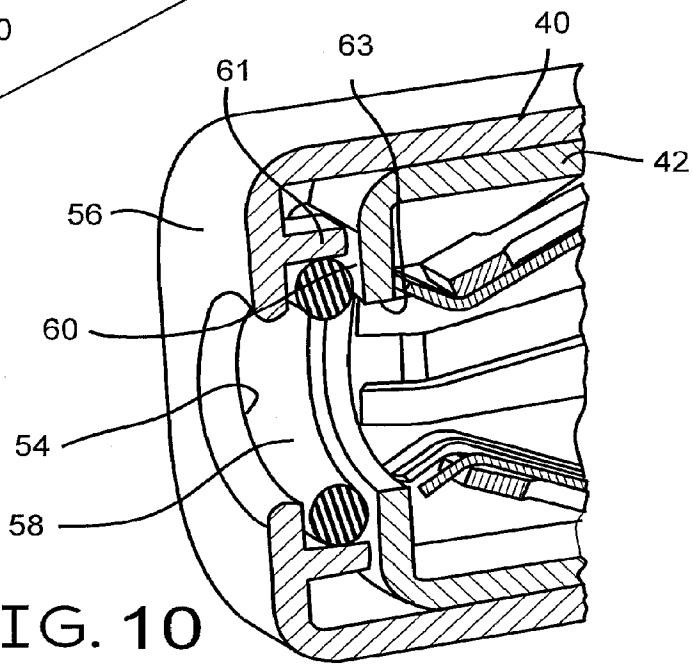
FIG. 10 is an enlarged partial cross-sectional view of one end of the plug assembly of FIG. 2.

As shown in FIGS. 9 and 10, a pin seal 58 is disposed between an end wall 60 of the inner housing 42 and the end wall 56 within the interior of the outer housing 40. The end wall 60 of the inner housing 42 includes an aperture 63 formed therein through which the electrical pin 26 extends when the plug assembly 16 is inserted into the socket assembly 14. The pin seal 58 is shown in the form or an elastomeric O-ring. Of course, the pin seal 58 may have any suitable shaped or configuration. As shown in FIG. 10, the outer housing 40 includes a ring shaped flange 61 formed on the end wall 56 to help retain the pin seal 58. When the plug assembly 16 is assembled and inserted into the socket assembly 14, as shown in FIG. 8, the pin seal 58 engages with the outer surface of the pin 26 to provide protection of the terminal wire housing assembly 44 from the outside environment. Sealing the interior of the plug assembly 16 may have the advantage of using aluminum components and wires (such as the pin 26, the terminal 76, or the wire 70) which are susceptible to oxidation and corrosion if not sufficiently protected from the environment. Conventional bolt and eyelet connectors that are not in a sealed environment are not well suited to be made from aluminum. Aluminum reduces cost compared to using copper wire and copper components. Aluminum additionally provides weight savings. It is noted that because of the arrangement of the pin seal 58, a sealing structure (not shown) may not be needed between the outer housing 40 of the plug assembly 16 and the tubular portion 22 of the housing 20 of the socket assembly 14. The lack of this type of sealing structure on the socket assembly 14 can reduce cost by simplifying part manufacturing of the socket assembly 14. The lack of the additional sealing structure on the socket assembly 14 also enables easier retrofitting of existing electrical components, such as motors, alternators, starters, and batteries for use with the plug assembly 16.

Figure 6:
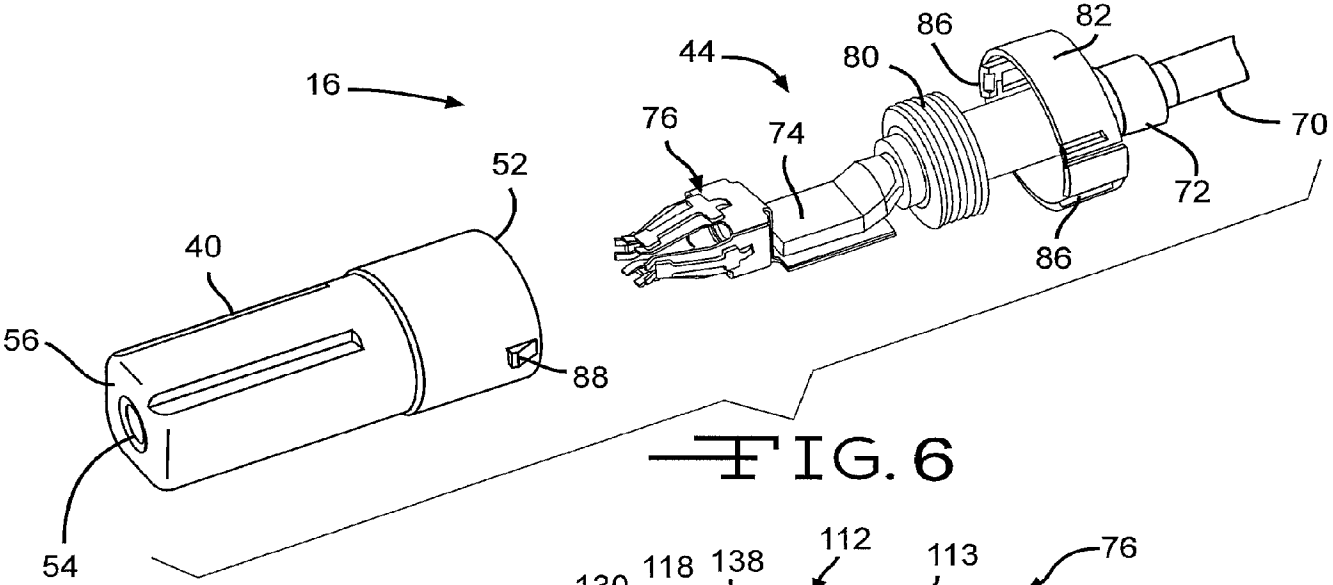
FIG. 6 is an exploded perspective view of the plug assembly of FIG. 2.

Referring to FIG. 6, the terminal wire housing assembly 44 includes an insulated wire 70 having a jacket 72. The wire 70 has an end 74 which is connected to an electrical terminal, indicated generally at 76. As will be explained below, the terminal 76 engages with the pin 26 of the assembly 14 to provide electrical communication between the pin 26 and the wire 70.

As shown in FIGS. 6 and 8, a ring shaped elastomeric wire seal 80 seals the outer surface of the wire 70 and an inner cylindrical surface 83 of the outer housing 40 adjacent the opening 52. A wire seal retainer 82 closes off the opening 52 of the outer housing 40. The wire 70 and the jacket 72 extend through an aperture 84 of the wire seal retainer 82. As shown in FIG. 6, the wire seal retainer 82 may be connected to the outer housing 40 by resilient arms 86 formed on the wire seal retainer 82 which engage with hooks 88 formed on the outer housing 40.

Figure 11:
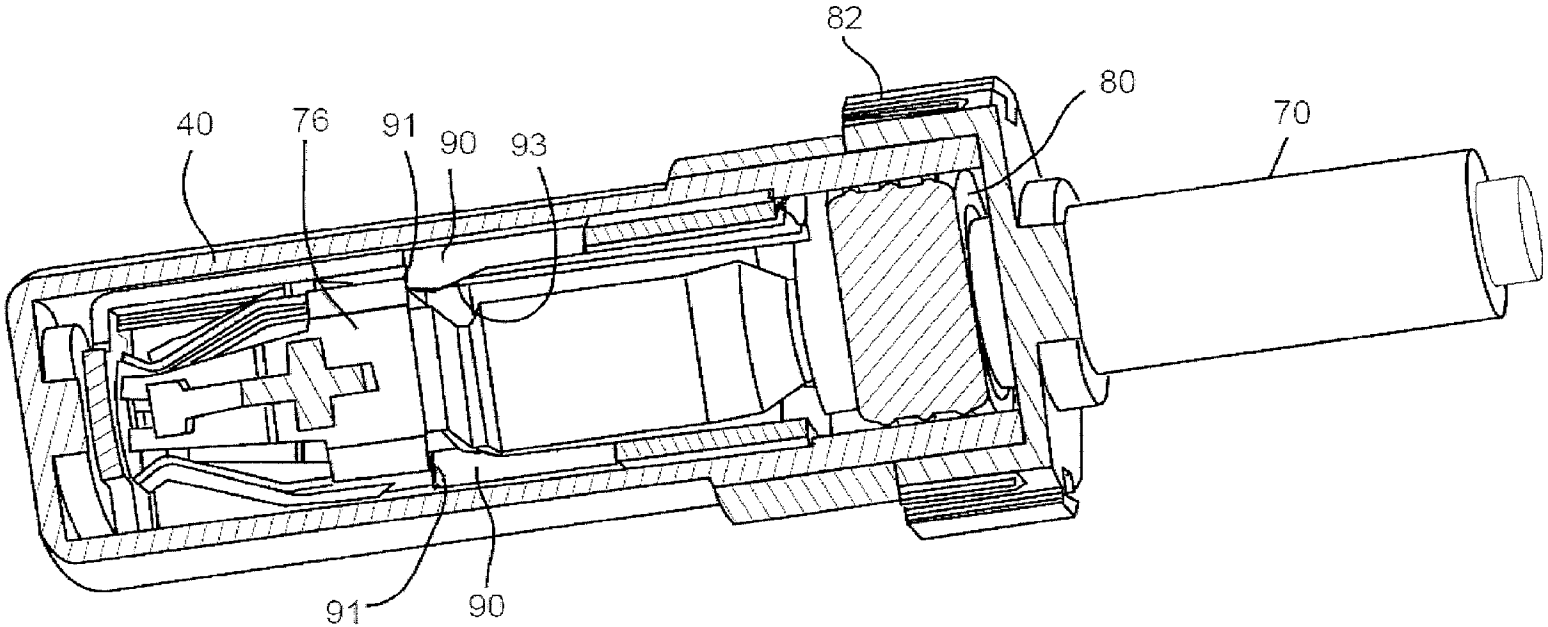
FIG. 11 is a partial cross-sectional view of the plug assembly illustrating a resilient locking feature for mounting the terminal wire housing assembly within the inner housing.
Figure 12:
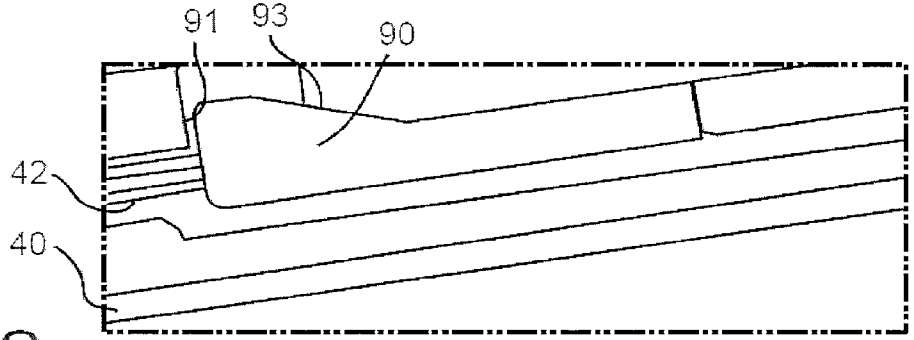
FIG. 12 is an enlarged partial cross-sectional view of the locking feature shown in FIG. 11.

As shown in FIGS. 11 and 12, the terminal wire housing assembly 44 may be retained in the inner housing 42 by resilient arms 90 formed on the inner housing 42 which engage with the terminal 76 by a snap fit type of connection. The terminal 76 is inserted into the inner housing 42 such that the arms 90 are flexed outwardly until the terminal 76 has moved a sufficient distance within the inner housing 42 and the arms 90 move inwardly to retain a back edge 91 of the terminal 76. The arms 90 may include inwardly facing ramped surfaces 93 to assist in flexing the arms outwardly during insertion of the terminal 76.

Figure 7:
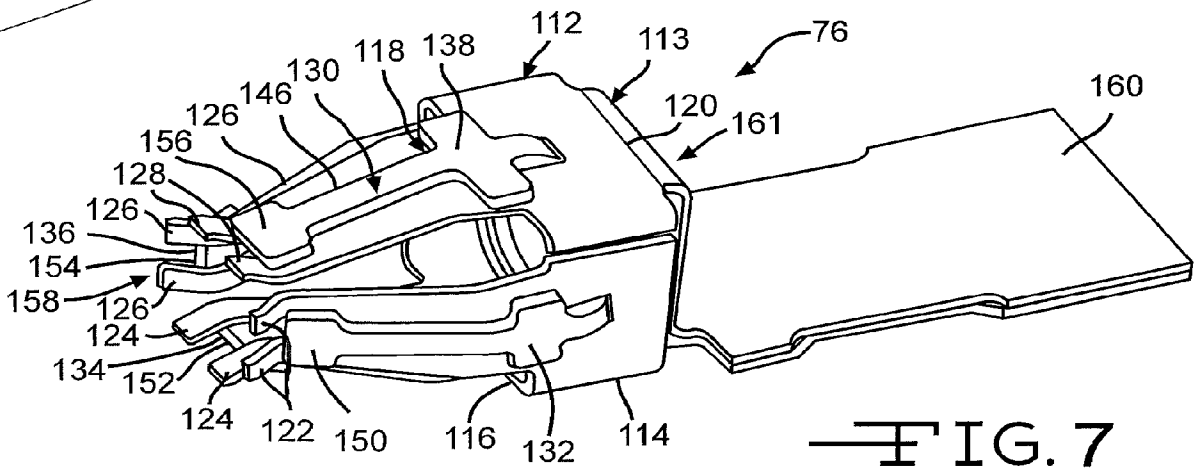
FIG. 7 is an enlarged perspective view of an electrical terminal of the plug assembly of FIG. 6.

The terminal 76 can be any suitable structure which engages with and provides electrical communication with the pin 26 of the socket assembly 14. There is illustrated in FIGS. 6 through 8 one embodiment of the terminal 76. Referring to FIG. 7, the terminal 76 includes a contact portion 112 having a contact portion base 113 having sides 114, 116, 118, and 120 forming a generally rectangular structure. The contact portion 112 further includes four pairs of contact arms 122, 124, 126, and 128, each extending from a respective one of the sides 114, 116, 118, and 120. The contact arms 122, 124, 126, and 128 are arranged to receive the pin 26 such that each pair of contact arms 122, 124, 126, and 1 28 contacts the outer cylindrical surface of the pin 76.

The terminal 76 may also include a spring arrangement 130 that includes four spring arms 132, 134, 136, and 138. Each of the spring arms 132, 134, 136, and 138 has a respective spring body 140, 142, 144, and 146 disposed along a central portion of a respective pair of the contact arms 122, 124, 126, and 128. Each of the spring arms 132, 134, 136, and 138 also includes a respective spring head 150, 152, 154, and 156 in contact with a respective pair of the contact arms 122, 124, 126, and 128 near a distal end 158 of the contact portion 112. The spring heads 150, 152, 154, and 156 apply a force to the respective pair of contact arms 122, 124, 126, and 128 in a direction that is toward an opposite pair of the contact arms. For example, the spring head 156 applies a force to the contact arms 128 in a direction toward the opposite pair of contact arms 214. Similarly, the contact head 134 applies a force to the contact arms 124 in a direction toward the opposite pair of contact arms 128. The configuration of the spring arrangement, and in particular the contact of the spring heads to the respective pairs of contact arms, increases the retention force that will be applied to the pin 76.

Although the embodiment shown in FIG. 7 is a four-sided generally rectangular structure, the terminal 76 may include less than or more than four sides to create a different type of generally polyhedron structure. For example, a three-sided structure may have a generally triangular cross-section, and a five sided structure may have a generally pentagonal cross section. In such a case, a spring would not apply a force to a set of contact arms in a direction toward an opposite pair of contact arms since the above examples have an odd number of sides. Regardless of the number of sides, however, the springs will apply a force toward the respective contact arms in a direction toward a central axis of the terminal 76 corresponding to the central axis of the pin 76.

A terminal, such as the terminal 76, may be effective for use in high current applications, where a soft copper conductor may lose its retention force in the presence of the potentially high heat associated with some high current applications or applications operating in high heat environments. To help avoid this problem, some prior art electrical terminals use a copper alloy that may have better high-temperature properties. However, this is often to the detriment of the conductivity which may be better with a more pure copper or with a softer copper alloy. In the electrical terminal shown in FIG. 7, the contact portion 112 can be made from a relatively soft copper material, such as C151, while the spring arrangement 130 can be made from a relatively stiff and strong steel, such as 301 stainless steel.

Although the tension applied to the contact arms 122, 124, 126, and 128 by the spring heads 150, 152, 154, and 156 would usually be adequate to keep the components in their relative orientations, the embodiment shown in FIG. 7 provides an additional feature to further ensure that the relative orientation is maintained. As shown in FIG. 7, each of the spring bodies 140, 142, 144, and 146 has at least a portion disposed between a respective pair of the contact arms 122, 124, 126, and 128, which helps to ensure that the spring heads 150, 152, 154, and 156 are in the proper position and apply the force fairly equally between each of the respective contact arms in the pairs of contact arms 122, 124, 126, and 128.

Also shown in FIG. 7, the contact portion 112 includes a platform 160 configured to connect with the wire 70 or other electrical component, for example, by sonic welding. The platform 160 extends from a proximal end 161 of the contact portion 112. The platform 160 can have any suitable shape for mating with the wire 70 (or other electrical component) and can extend from any of the sides 114, 116, 118, and 120 or combination of the sides 114, 116, 118, and 120 of the contact portion 112.

Figure 13:
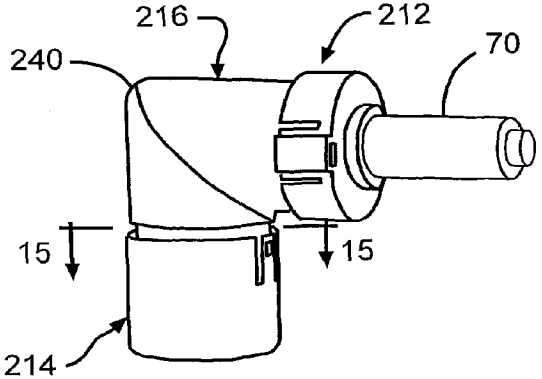
FIG. 13 is a perspective view of a second embodiment of a connector assembly in accordance with the present invention.
Figure 14:
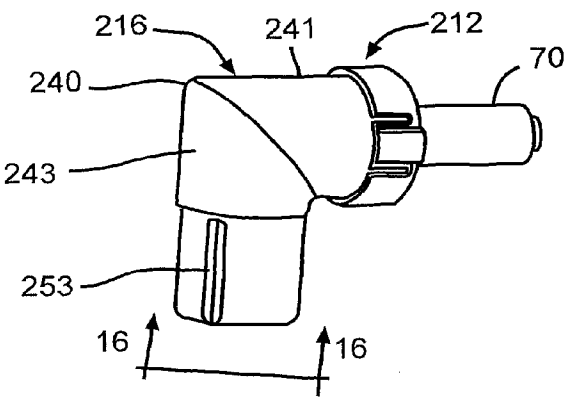
FIG. 14 is a perspective view of the plug assembly of the connector assembly of FIG. 13.
Figure 15:
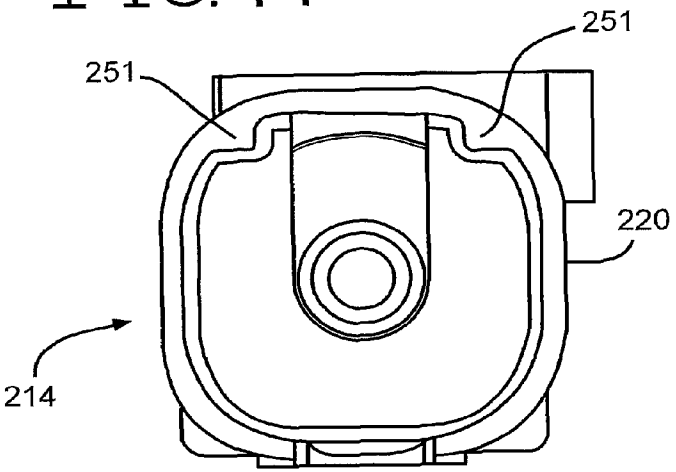
FIG. 15 is an end view of the mating end of the socket assembly of the connector assembly of FIG. 13.
Figure 16:
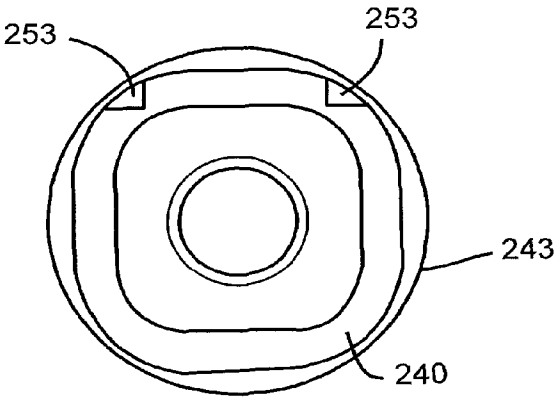
FIG. 16 is an end view of the mating end of the plug assembly of the connector assembly of FIG. 13.

There is illustrated in FIG. 13 a second embodiment of a connector assembly, indicated generally at 212. The connector assembly 212 is similar to the connector assembly 12 but has a plug assembly 216 having a 90 degree or right angle configuration. In this embodiment, an outer housing 240 has a first portion 241 which receives a terminal wire housing assembly, such as the terminal wire housing assembly 44, and a second portion 243 which is inserted into a socket assembly 214. The first and second portions 241 and 243 are generally at right angles relative to one another. This right angle configuration may be useful under certain packaging constraints where an elongated plug assembly does not fit or where it is desirable to initiate the routing of the wire 70 in a desired direction. It should be understood that the first and second portions 241 and 243 may be offset from one another by any suitable angle other than 90 degrees as is shown in FIGS. 13 through 16.

To assure that the plug assembly 216 is connected to the socket assembly 214 in a proper orientation, the connector assembly 212 may have a polarity or one way installation feature to prevent the connector assembly 212 from being connected improperly. Although electrical communication between the pin (not shown) and the terminal (not shown) of the connector assembly 212 may still be sufficient if plugged in an improper orientation, the direction or angle of the wire 70 may be incorrect such that excessive bending of the wire 70 may result. In the embodiment shown in FIGS. 13 through 16, the socket assembly 214 and the plug assembly 216 are keyed such that they will engage one another in one correct orientation. More specifically, the socket assembly 214 includes a pair of protrusions 251 formed on a housing 220 of the socket assembly 214 which line up with a pair of recesses 253 formed on the second portion 243 of the outer housing 240. Of course, the connector assembly 212 can be configured in any suitable manner which provides for this keying function.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A plug assembly that is adapted to be connected to a socket assembly having an electrical pin to form a connector assembly, the plug assembly comprising:

an outer housing including a first end having an opening and a second end having an end wall with an aperture that is adapted to receive an electrical pin of a socket assembly when the socket assembly is connected to the plug assembly to form a connector assembly;

an inner housing disposed within the outer housing and including a first end having an opening and a second end having an end wall with an aperture that is adapted to receive the electrical pin of the socket assembly when the socket assembly is connected to the plug assembly to form the connector assembly;

an electrical terminal disposed in the inner housing and adapted to receive the electrical pin of the socket assembly when the socket assembly is connected to the plug assembly to form the connector assembly;

a wire having a first end that is connected to the electrical terminal and a second end that extends through both the opening in the first end of the outer housing and the opening in the first end of the inner housing;

a pin seal disposed between the end wall of the outer housing and the end of the inner housing and that is adapted to sealingly engage the electrical pin of the socket assembly when the socket assembly is connected to the plug assembly to form the connector assembly; and a wire seal sealingly engaging both the outer housing and the wire.

2. The plug assembly defined in claim 1 wherein the inner housing is secured to the outer housing by a fastening structure provided on the inner housing that cooperates with a recess provided on the outer housing.

3. The plug assembly defined in claim 1 wherein the outer housing includes an inner surface, and the wire seal sealingly engages both the inner surface of the outer housing and the wire.

4. The plug assembly defined in claim 1 further including a wire seal retainer that sealingly engages both the outer housing and the wire.

5. The plug assembly defined in claim 4 wherein the outer housing includes an outer surface, and the wire seal retainer sealingly engages both the outer surface of the outer housing and the wire.

6. The plug assembly defined in claim 4 wherein the outer housing includes both an inner surface and an outer surface, the wire seal sealingly engages both the inner surface of the outer housing and the wire, and the wire seal retainer sealingly engages both the outer surface of the outer housing and the wire.

7. The plug assembly defined in claim 4 wherein the wire seal retainer is secured to the outer housing by a resilient arm provided on the wire seal retainer that engages a hook provided on the outer housing.

8. The plug assembly defined in claim 1 wherein the inner housing includes a resilient arm that engages the electrical terminal and retains the electrical terminal in the inner housing.

9. The plug assembly defined in claim 1 wherein the outer housing has first and second portions that are oriented at a right angle relative to one another.

* * * * *